United States Patent [19]

Robinson et al.

[11] 4,187,756

[45] Feb. 12, 1980

[54] AUTOMATIC ARPEGGIATOR

[75] Inventors: John W. Robinson; Stephen L. Howell, both of Jasper, Ind.

[73] Assignee: Kimball International, Inc., Jasper, Ind.

[21] Appl. No.: 850,591

[22] Filed: Nov. 11, 1977

[51] Int. Cl.[2] ..... G10H 1/00; G10H 5/00

[52] U.S. Cl. ..... 84/1.24; 84/1.17; 84/1.03; 84/DIG. 22

[58] Field of Search ..... 84/1.17, 1.24, 1.01, 84/1.03

[56] References Cited

U.S. PATENT DOCUMENTS

| | | | |
|---|---|---|---|
| 3,842,184 | 10/1974 | Kniepkamp et al. | 84/1.01 |
| 3,854,366 | 12/1974 | Deutsch | 84/1.24 |
| 4,120,225 | 10/1978 | Dietrich et al. | 84/1.03 |

*Primary Examiner*—B. Dobeck
*Assistant Examiner*—J. Conklin
*Attorney, Agent, or Firm*—Albert L. Jeffers; John F. Hoffman

[57] ABSTRACT

An electronic organ employing the technique of multiplexing at least the solo portion of the keyboard and which includes an automatic chord playing circuit which plays chords in the solo voices corresponding to the accompaniment portion of the keyboard in response to depression of one of a predetermined group of keys of the accompaniment portion of the keyboard. The organ includes circuitry for automatically sounding notes corresponding to the chord selected in the accompaniment portion singly and sequentially from a selected end of the solo portion of the keyboard to the opposite end thereof, and further selectable to begin at one end of the solo manual proceeding to the other end thereof and sounding in reverse order back to the first mentioned end of the manual. If desired, the arpeggio run may be terminated at a selected point on the keyboard short of either end thereof.

19 Claims, 4 Drawing Figures

AUTOMATIC ARPEGGIATOR

BACKGROUND OF THE INVENTION

Electronic organs commonly include circuits for producing special musical effects, such as for automatically sounding the notes of a chord in response to depression of a single key of, for example, a selected group thereof in the accompaniment portion of the keyboard. In addition to simply sounding the notes of a chord while such a "chord playing" key is depressed, some organs also include circuits which will cause the notes of the chord to sound intermittently.

The present invention relates to an improved circuit for sounding the notes of a chord selected by a "chord playing" key in the accompaniment manual portion of the keyboard and, in particular, for sounding the notes of the chord in succession in each of the octaves of the solo portion of the keyboard sequentially and beginning at either end of the manual as selected by the player and continuing to the opposite end or any point in between.

A third selectable mode provides for the sounding of the notes of the chord to begin at one end of the solo manual, for example, the lower end, and to sweep up to the upper end of the manual and then back to the lower end. The circuit will complete one full cycle, as selected, each time a chord playing key is tapped and will continue with repetitive cycles if the key is held depressed. The arpeggio run may be terminated at any time by releasing the arpeggio enable switch.

SUMMARY OF THE INVENTION

The present invention relates to electronic organs and the like, and especially to those organs which employ the technique of multiplexing at least the solo manual, for repetitively producing a solo data stream with each data stream containing logic signals in respective time slots for each key of the manual, with the logic levels of the signals indicating the keys that are released and the keys that are depressed during the respective scan. Each solo data stream is then demultiplexed and notes under control of those logic signals corresponding to depressed keys are sounded.

The present invention is further intended for use with those electronic organs which include a special effect circuit for sounding of notes, or groups of notes, in the accompaniment manual voices, such as a circuit which will cause the sounding of chords in the accompaniment voices in response to depression of a single one of a predetermined group of keys ("chord playing" keys) of the accompaniment manual.

The present invention, when activated, will receive a signal from the accompaniment manual corresponding to the depressed one of the "chord playing" keys and will develop a special control word indicating which three notes the selected chord consists of. A timing circuit including a variable speed and variable duty cycle clock sequentially, running at a rate much slower than multiplexing rate, selects the signal corresponding to one of the notes of the chord to form the input to a twelve line multiplexer.

A second timing circuit enables the twelve line multiplexer for the period during which the solo manual multiplexer is scanning a single octave of the solo manual.

More specifically, the second timing circuit enables the twelve line multiplexer initially during the period when the solo manual multiplexer is scanning the lowermost octave of the solo manual. After the first timing circuit has sequentially enabled the three note indicating signals corresponding to the chord pertaining to the actuated playing key of the accompaniment manual, the second timing circuit will enable the twelve line multiplexer during the time the solo manual multiplexer is scanning the second octave from the lower end of the manual, and the first timing circuit will again sequentially enable the note signals. This sequence will continue until the three notes selected by the chord playing key of the accompaniment manual have been sounded sequentially in each of the octaves of the solo manual.

The primary objective of the present invention is to provide an improved method for sounding of the notes of a chord as an arpeggio in the solo manual of an organ.

A further objective of the present invention is to provide a circuit for automatically sounding of the notes of a chord in the solo manual voices of an organ in an arpeggio effect and which is compatible with the multiplexing arrangement of the solo manual and the automatic chords circuitry associated with the accompaniment manual of the organ.

The exact nature of the present invention will become more apparent upon reference to the following detailed specification taken in connection with the accompanying drawings in which.

DETAILED DESCRIPTION

Figure 1:
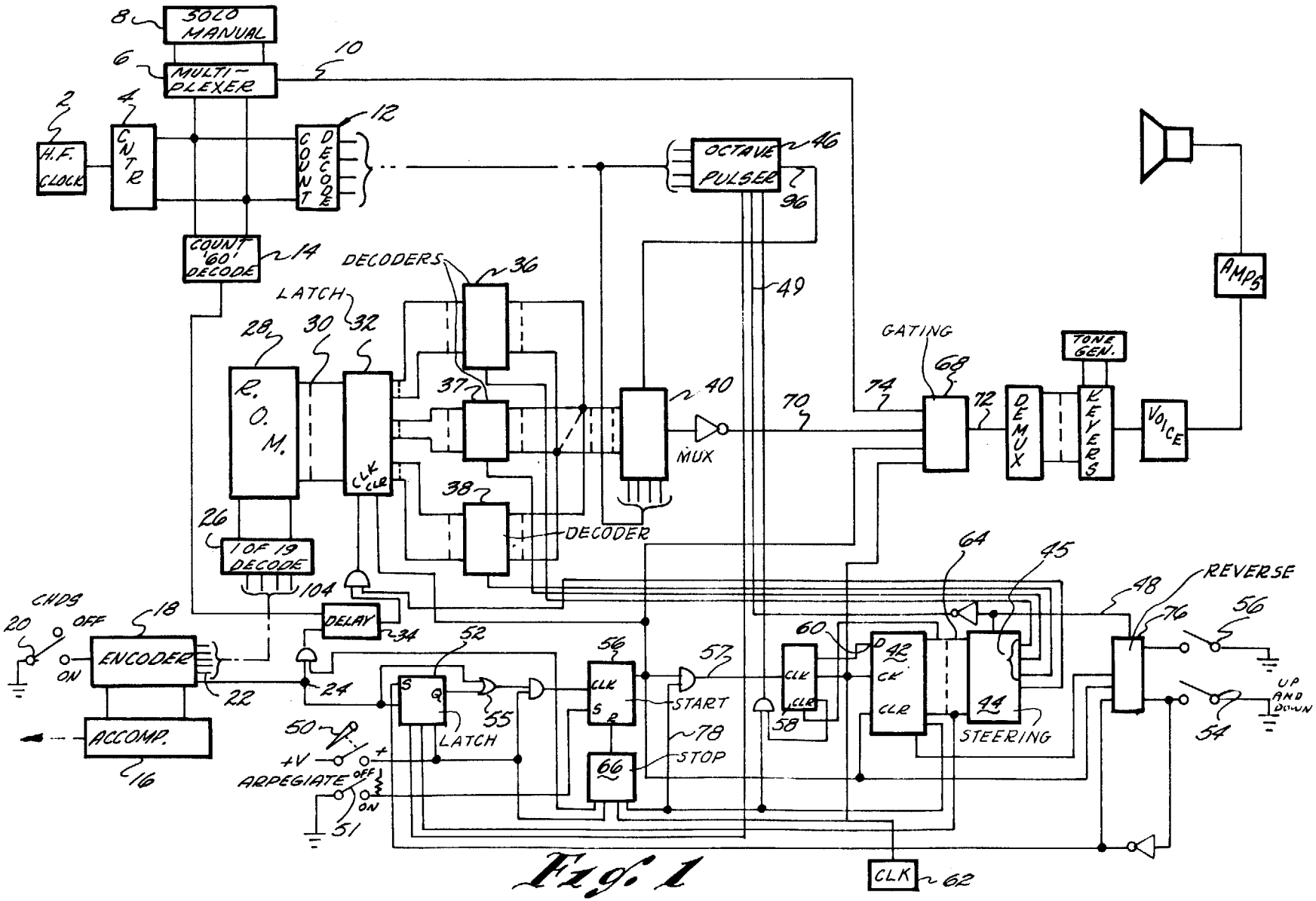
FIG. 1 is a simplified block diagram of a portion of the circuits of an electronic organ embodying the circuitry of the present invention.

Referring to FIG. 1, a high frequency, say 30 Kilohertz, clock 2 provides a clock train to a counter 4 which provides a six bit count output which is connected to the controlling terminals of a multiplexer 6. Multiplexer 6 repetitively scans the keys of solo manual 8 and produces a data stream on line 10 on each scan. Each data stream consists of time displaced bits corresponding to the keys of the solo manual with bits corresponding to the depressed keys being at a different logic level from the others in the data stream.

The outputs of counter 4 are also connected to a code converting circuit 12 which produces a four bit code indicating the note name of the key which multiplexer 6 is scanning at any given time. That is, the four bit output of code converter 12 cycles from count zero through count eleven five times, while the six bit output of counter 4 cycles from zero to sixty, and holds at count thirteen during three further counts of the output of counter 4. The output of code converter 12 thus provides a signal which indicates the note name of the key being scanned by multiplexer 6 at any given time.

The output of counter 4 is also connected to a second decoding circuit 14, labeled "count sixty decode" in FIG. 1, and which produces a single output pulse during the time period when the output of counter 4 is at count sixty.

Also shown in FIG. 1, is the accompaniment manual 16 and the accompaniment manual encoder 18. The circuitry associated with accompaniment manual 16 for sounding of accompaniment voices forms no part of the present invention and is not shown in FIG. 1.

A chords "ON-OFF" switch 20 is shown in FIG. 1. When switch 20 is switched to the "ON" position, the keys of the accompaniment manual are disabled for conventional operation and, instead, a group of keys, for example nineteen keys, thereof are enabled for playing chords. When switch 20 is "ON," accompaniment manual encoder 18 will produce a five bit output on cable 22 consisting of a binary coded word for each of the "chord playing" keys that is depressed, and a second (key-down) output on line 24 consisting of a logic 1 signal anytime any one of the "chord playing" keys of the accompaniment manual is depressed.

Cable 22 from encoder 18 is connected to a one-of-nineteen decoder 26. It should be noted that the size of decoder 26 is commensurate with the number of "chord playing" keys that the organ includes. Decoder 26 addresses a nineteen line by twelve bit read only memory (ROM) 28. For each chord playing key which is depressed on the accompaniment manual 16, a respective line of read only memory 28 will be addressed. Each line of ROM 28 produces a respective twelve bit output 30 which is connected to a twelve bit latch 32.

The key-down output pulse on line 24 of encoder 18 is connected to the input of a delay block 34, which provides a delay having a duration of one multiplexing scan and then supplies an output corresponding to the signal at the input terminal thereof.

The key-down signal thus developed at the output of delay block 34 provides a rising edge to the clock terminal of a twelve bit latch 32 transferring the twelve bit output of read only memory 28 to the twelve bit output side of latch 32 each time a "chord playing" key is depressed. The output of latch 32 is connected in groups of four to the inputs to each of three one-of-twelve decoders 36, 37 and 38. The twelve bit output of decoders 36, 37 and 38 corresponds to one octave of a keyboard with each bit corresponding to a particular note in the octave.

Each decoder will enable a single one of the outputs thereof for each four bit control word input thereto from latch 32. Each of decoders 36, 37 and 38 therefore converts a portion of the output of ROM 28 into a signal corresponding to a particular note within an octave.

The outputs of decoders 36, 37 and 38 are then used to cause notes to sound by inserting the output of one of the decoders on a twelve bit data stream, and inserting the data stream in place of an octave portion of the solo manual data stream. This is accomplished by connecting the outputs of decoders 36, 37 and 38 together to form a single twelve line input to a twelve line to one line multiplexer 40.

The decoders 36, 37 and 38 are individually, and sequentially, enabled by the outputs of a sixteen bit shift register 42 through a steering logic component 44, which will be described in detail hereinafter. The outputs of the enabled one of the decoders 36, 37 and 38 will control the inputs to the twelve line multiplexer 40.

Twelve line multiplexer 40 is enabled during the time period when multiplexer 6 is scanning a single octave of solo manual 8. The octave during which multiplexer 40 is enabled is controlled by an octave pulser circuit 46. Octave pulser 46 determines which portion of the solo manual data stream will be replaced or added to by the twelve bit data stream at the output of multiplexer 40 and, thus, determines the octave in which the selected note will sound. Octave pulser 46 developes an enabling pulse at output 96 during the time period during which multiplexer 6 is scanning a particular octave of manual 8. Initially, a pulse is developed at output 96 when multiplexer 6 is scanning the lowest octave of manual 8, hereinafter referred to as lowest octave time period. Octave pulser 46 will continuously develop pulses at output 96 during the lowest octave time period while shift register 42 sequentially enables each of decoders 36, 37 and 38 once.

Octave pulser 46 thereafter enables multiplexer 40 for the time period corresponding to each of the octaves of manual 8, enabling each of decoders 36, 37 and 38 during each octave time period prior to shifting to the next octave time period. p In review, the outputs of shift register 42 repetitively and sequentially enable decoders 36, 37 and 38 while octave pulser 46 enables multiplexer 40 during sequential multiplexer octave time periods, creating the effect of playing three notes, singly and sequentially, in each octave of manual 8. The duration of each note is determined by the clocking input to shift register 42, which is set to cause closely spaced notes to create an arpeggio. Clock 62, which clocks register 42, may run at from 1 to 10 Hertz and in the present invention is a variable duty cycle clock. This enables staccato notes to be sounded when the duty cycle is short and legato notes when the duty cycle is long.

The remainder of the circuit shown in FIG. 1 is the control portion of the circuit of the present invention and controls initiating and terminating the operation of shift register 42, octave pulser 46, latch 32 and gating block 68.

Operation of the circuit is initiated by switching a circuit enable selector switch, labeled "Arpeggiate ON-OFF," on, operating a circuit enable switch, such as a knee operated switch, 50 and depressing one of the "chord playing" keys. When switch 50 is closed, the "up and down" and key-down latch 52 is enabled. Thereafter, the next rising edge of the key-down output of encoder 18 will clock latch 52. The D input to latch 52 indicates the position of control switch 54.

Control switch 54, as shown in FIG. 1, is labeled "up and down", and when closed, the operation of the circuit will be to enable the decoders 36, 37 and 38 in order during the period the multiplexer 6 is scanning the lowermost octave of solo manual 8 to enable the decoders sequentially during each of remaining octaves of solo manual 8 until each of the decoders 36, 37 and 38 has been enabled while multiplexer 6 is scanning the uppermost octave of solo manual 8; and will then enable each of decoders 36, 37 and 38 in reverse order during each of the octaves of solo manual 8 in the order from right to left until each of the decoders 36, 37 and 38 has again been enabled during the scanning of the lowermost octave of solo manual by multiplexer 6.

When selector switch 54 is in the open position, as shown in FIG. 1, selector switch 56 will determine the order in which the decoders 36, 37 and 38 are enabled and the octave during which multiplexer 40 will first be enabled. With switch 56 as shown in FIG. 1, multiplexer 40 will be enabled during the uppermost octave of solo manual 8 first.

Turning to latch 52, the Q output of latch 52 will be set to logic 1 only when switch 54 is closed and a key-down pulse occurs at output 24 of encoder 18.

The Q output of latch 52 and the output 24 of encoder 18 are OR'd together in OR gate 55 and connected to the clocking terminal of a start latch 56. The output of latch 56 is connected through an AND gate 57 to the clocking terminal of a start pulser latch 58.

Thus, when a key of accompaniment manual 16 is depressed, the rising edge of the key-down signal at outpt 24 will clock latch 56, which will, in turn, clock latch 58. The output of latch 58 will, thus, provide a logic 1 input to the data in terminal 60 of shift register 42.

Shift register 42 is clocked by low frequency clock 62 and will transfer the logic 1 signal at terminal 60 to the first output bit thereof 64. Clock 62 may run at from, say, 1 to 10 Hertz. Output 64 provides a clearing signal to latch 58 which removes the logic 1 signal from input terminal 60 of shaft register 42. In this manner, a single logic 1 signal is inserted into shift register 42 each time a key of accompaniment manual 16 is depressed. The logic 1 signal in shift register 42 will then shift sequentially to each of the sixteen outputs thereof as clock 62 pulses.

The first fifteen outputs of shift register 42 are connected to the inputs of the steering logic 44, which will be described in greater detail hereinafter, while the sixteenth output of shift register 42 is connected through stop logic block 66 to reset the start latch 56. As can be seen in FIG. 1, the output of start latch 56 also provides an enabling signal to a clear terminal of latch 32, to shift register 42 and a control signal to a data lock-out gating block 68.

Steering logic 44 receives the fifteen outputs of shift register 42 as mentioned, and a control signal input from reversing logic 76. Reversing logic 76 develops a logic 0 signal at output 49 whenever the note pattern is to proceed from left to right on solo manual 8 and a logic 1 whenever the note pattern is to proceed from right to left.

As the logic 1 signal shifts through shift register 42, steering logic 44 develops an enabling signal at each of three output terminals 45. When output 49 of reversing logic 76 is a logic 1, steering logic 44 will enable outputs 45 in order, from top to bottom, in FIG. 1, for instance, while with a logic 0 signal at output 49, outputs 45 will be enabled in reverse order.

As can be seen in FIG. 1, each of the wires forming the output 45 is connected to one of decoders 36, 37 and 38. Steering logic 44 converts the logic 1 signal shifting through the first bits of shift register 42 into a logic 1 signal repetitively shifting through a three wire output 45 of steering logic 44, with the direction of shifting of the logic signal through the output wires of output 45 determined by output 49 of reversing logic 76. Shift register 42 and steering logic 44 enable decoders 36, 37 and 38 in either forward or reverse order five times when a start signal is developed by latch 58.

The remainder of the detailed description will detail the components of each of the logic blocks just discussed.

Figure 3:
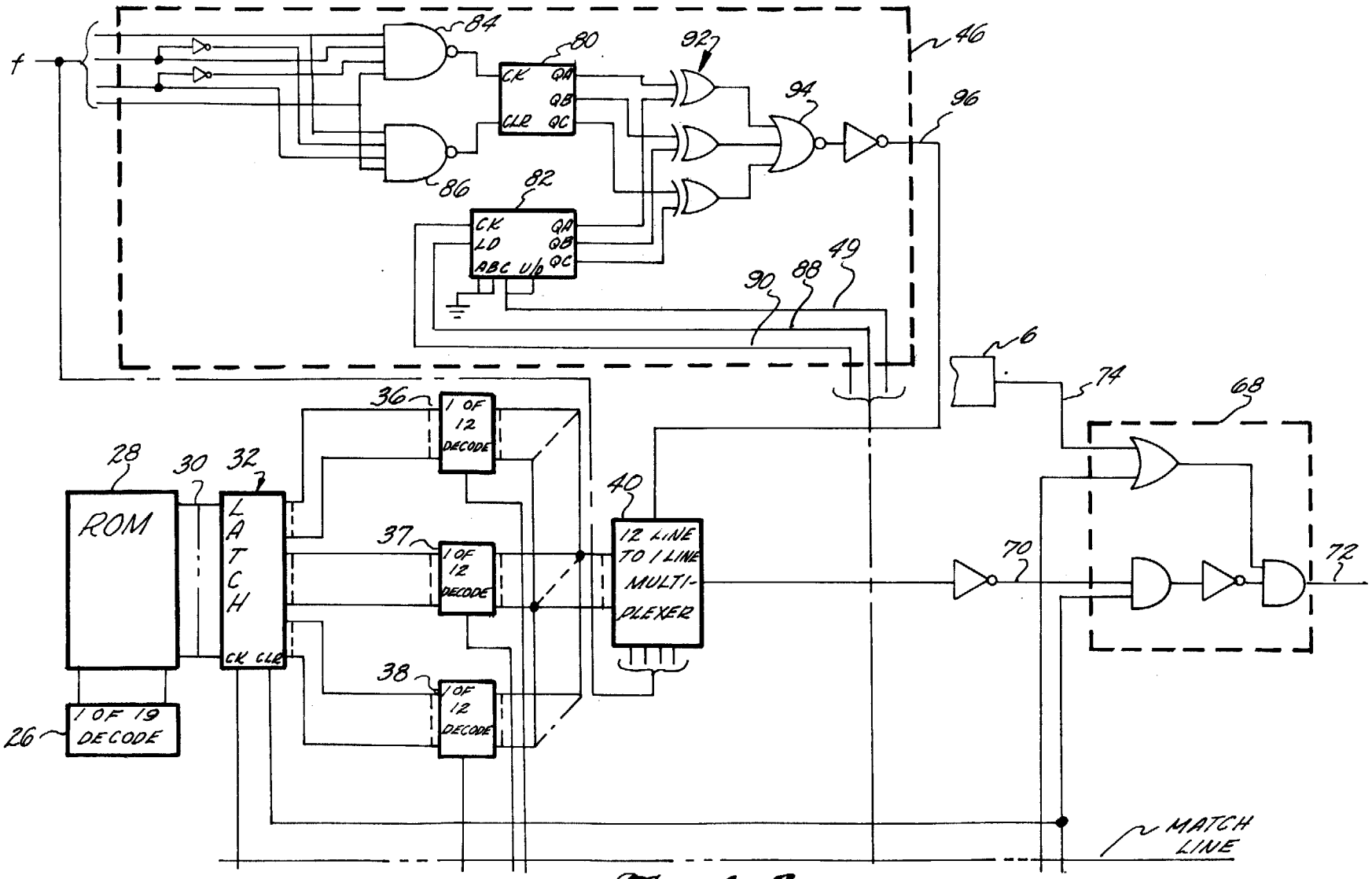
FIG. 3 is a detailed schematic diagram of the portion of the circuit of the present invention not shown in FIG. 2.

Referring first to FIG. 3, octave pulser 46 is shown in a dotted block labeled 46. Octave pulser 46 consists of a pair of three bit counters 80 and 82. The four bit input word from count decoder 12 is connected through NAND gates 84 and 86 as shown in FIG. 3 to provide a pulse to the clocking terminal of octave scanned counter 80 during a specific count of the output of code converter 12 and a pulse to the clear terminal, labeled CLR, during a second specific count from the output of decoder 12. Specifically, NAND gate 84 provides a pulse to the clocking terminal of counter 80 whenever the outputs of code converter 12 reaches count 11. This will occur each time the solo manual multiplexer 6 scans the last key in each octave.

NAND gate 86 provides a pulse to the clear terminal of octave scanned counter 80 each time the output of code converter 12 reaches count 13. As previously mentioned, the output of code converter 12 reaches count thirteen only during the time period when the output of counter 4 reaches count 61, 62 and 63 or, after multiplexer 6 has completed a full scan of keyboard 8. Thus, counter 80 counts during each scan of manual 8, and thus indicates which of the octaves multiplexer 6 is currently scanning.

Desired octave 82, on the other hand, is controlled by three control inputs received from that portion of the circuit of the present invention shown in FIG. 2 and which will be discussed in more detail shortly.

Counter 82 consists of a presettable up/down counter, of which three bits are used to form a three bit counter. For ease of explanation, the operation of counter 82 will be discussed at this point while the generation of the three controlled signals will be discussed in reference to FIG. 2 hereinafter.

A first input 49 to counter 82 consists of a logic signal indicating whether the arpeggio is to be up or down, and is connected to both the up and down control terminal, labeled U/D in FIG. 3, and the input data C terminal labeled C in FIG. 3.

When an up arpeggio is required, the logic level on input 49 will be at logic 1, thus providing a logic 1 at the U/D terminal and the data C terminal. When the arpeggio is initiated, a pulse is provided at input 88 to counter 82, which is connected to the load terminal of counter 82. When input 88 is pulsed, the logic level at the three data input terminals A, B and C are transferred to the three output terminals Qa, Qb and Qc of counter 82. The third input 90 to counter 82 is connected to the clocking terminal of counter 82 and consists of pulses which occur once after each of the three decoders 36, 37 and 38 have been enabled, thus keeping track of the number of times the set of decoders have been enabled.

The output of counter 82 consists of a three bit word indicating the octave of manual 8 in which multiplexer 40 is to be enabled.

Counter 80 indicates which octave of manual 8 the multiplexer is currently scanning. The outputs of counters 80 and 82 are compared by a group of exclusive OR gates 92 and a NOR gate 94 to provide a pulse at output terminal 96 whenever the outputs of counters 80 and 82 are equal. Output 96 will thus consist of a logic 0 signal during the time period when multiplexer 6 is scanning a particular octave of manual 8, and during each scan of that octave, as controlled by counter 82.

For example, when a arpeggio has been selected by selector switch 56, the logic level at the up/down, and data in C terminals of counter 82 will be at logic 1. When a chord playing key of manual 16 is depressed, a pulse will be developed at input 88, thus causing the binary count 100, or count four, to be loaded into counter 82. This count four will cause the output 96 of octave pulser 46 to be pulsed to logic 0 each time multiplexer 6 scans the fifth octave of manual 8.

The system in use in the organ hereindescribed consists of first scanning the highest octave of manual 8 and scanning each adjacent octave thereto sequentially, so that the fifth octave will be the leftmost octave of manual 8.

Once each of decoders 36, 37 and 38 have been enabled, a pulse will be developed on wire 90, thus clocking counter 82. The logic 1 signal at the up/down control terminal to counter 82 will cause the counter to count down by one count. Thus, the output of counter 82 will now be a count three and output 96 of octave pulser 46 will be pulsed to logic 0 each time multiplexer 6 scans the fourth octave of manual 8. This sequence will continue until the output of counter 82 is at count 0, and octave pulser 46 enables multiplexer 40 during the time period when multiplexer 6 is scanning the first octave of manual 8.

In this manner, multiplexer 40 is enabled in a manner which develops a data stream simulating the playing of single notes in the solo manual 8 corresponding to an experienced player playing the three notes of a chord in an arpeggio fashion from the left end of manual 8 to the right end thereof.

Figure 2:
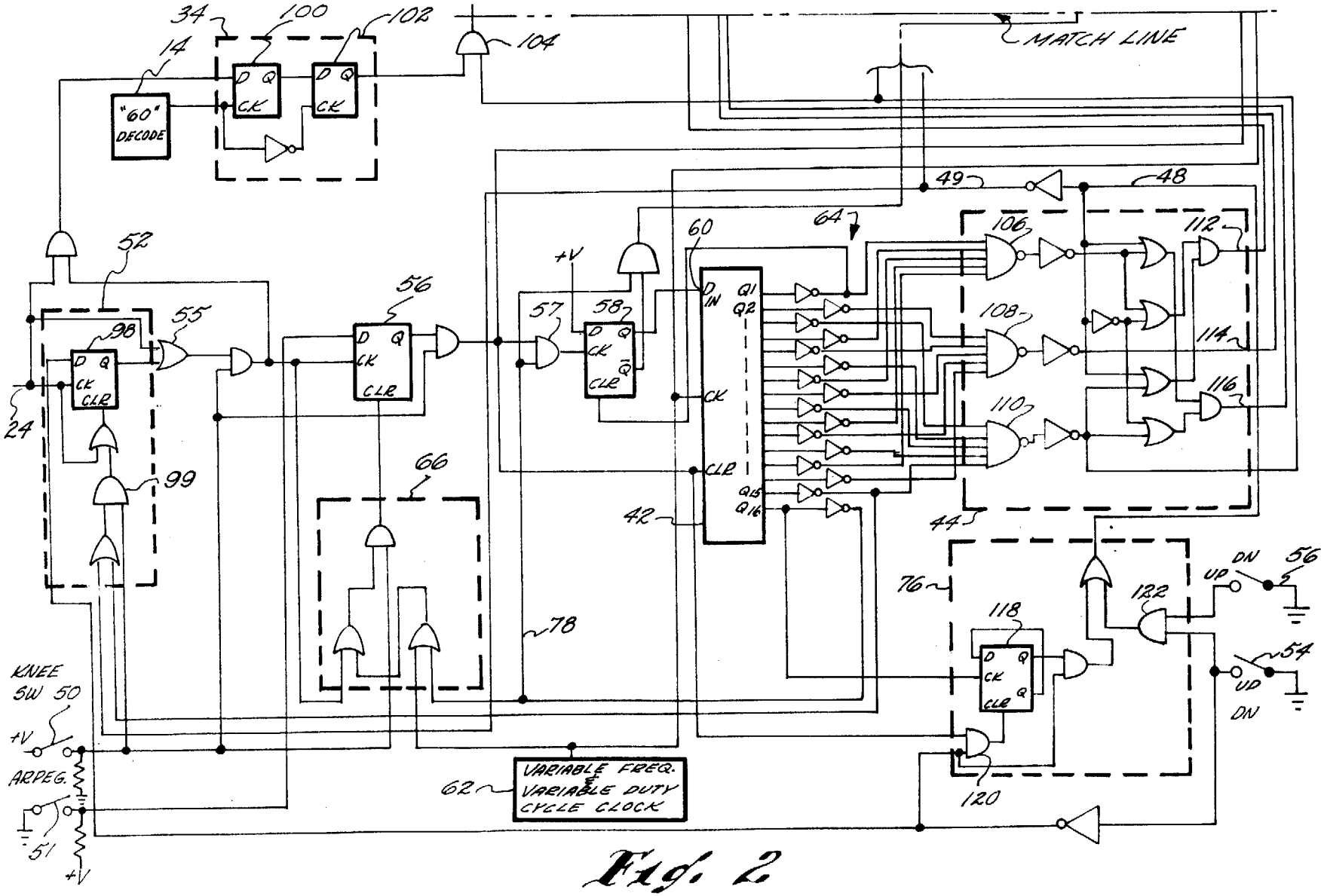
FIG. 2 shows a detailed schematic diagram of a portion of the circuit of the present invention.

Referring now to FIG. 2, the previously mentioned latch 52, delay block 34, shift register 42, steering logic component 44, stop block 66 and reversing logic 76 can be seen in more detail.

Latch 52 consists of a D type flop flop 98 with three logic gates connected to control the clear terminal thereto. The inputs to the three logic gates consist of the input from knee switch 50, the logic level of output 49 of reversing logic 76 and the 15th output of shift register 42.

Stop block 66 consists of three logic gates, two OR gates and one AND gate, and provides a clearing pulse to the clear terminal of latch 56 whenever knee switch 50 is released, or after the logic 1 signal inserted into shift register 42 has shifted therethrough to the sixteenth output, thus latch 56 is cleared either immediately upon the release of knee switch 50, or after a complete cycle of keyboard arpeggio has been completed.

Delay block 34 consists of a pair of D type flip flops 100 and 102. The output of count 60 decoder 14 is connected to the clocking terminal of flip flop 100 and through an inverter to the clocking terminal of flip flop 102. Pulses from the output of decoder 14 will first clock flip flop 100 and then clock flip flop 102. Since the output of decoder 14 pulses once at the end of each multiplexing scan of multiplexer 60, the logic level presented to the D input of flip flop 100 is developed at the Q output of flip flop 102 a time period corresponding to one multiplexing cycle later.

The Q output of flip flop 102 is connected through an AND gate 104 to the clocking terminal of latch 32, thus when a key-down signal first occurs on wire 24, a delay corresponding to the time required for multiplexer 6 to make one additional scan of keyboard 8, the clocking terminal of latch 32 will be pulsed thus latching in the output of ROM 28. This time delay insures that the data present at the output of ROM 28 when the clocking pulse is developed at AND gate 104 is stable and corresponds to the addressing input from decoder 26.

Shift register 42 consists of a sixteen bit shift register with each of the outputs connected through an inverter. As can be seen in FIG. 2, each of the first fifteen outputs of shift register 42 are connected to the input of steering logic 44, and more specifically to the inputs of one of three NAND gates 106, 108 and 110.

It will be seen that every third output of shift register 42, starting with the first output thereof, is connected to the inputs of NAND gate 106, while every third output starting with the second output of shift register 42 is connected to the inputs of NAND gate 108, and similarly, every third output of shift register 42 commencing with the third is connected to the inputs of NAND gate 110.

Thus, as the logic 1 signal is shifted through the first fifteen stages of shift register 42, each of the outputs of NAND gates 106, 108 and 110 are pulsed consecutively and repetitively five times. The sixteenth output of shift register 42 is connected first to an input of reversing logic 76 and through an inverter, along wire 78 to one input of stop logic 66.

Steering logic 44 converts the pulses developed at the outputs of NAND gates 106, 108 and 110 into pulses at outputs 112, 114 and 116. With a logic 0 on output 48 of reversing logic 76 the pulse occurring at the output of NAND gate 106 will cause a logic 0 pulse to occur at output terminal 116, while with a logic 1 signal present at output 48 of reversing logic 76, the output of NAND gate 106 will cause a logic 0 pulse to occur at output terminal 112.

Similarly, NAND gate 110 will either cause a pulse at output terminal 112 or output terminal 116, depending on the logic level of output 48 of reversing logic 76; thus, 48 of logic 76 converts the sequential pulses developed at the outputs of NAND gates 106, 108 and 110 into either a sequence of pulses occurring first at output terminal 112, then terminal 114 and then terminal 116, or a sequence of pulses occurring first on terminal 116, then 114 and then 112.

Output terminals 112, 114 and 116 are each connected to the enabling terminals of one of decoders 36, 37 and 38. Therefore, the logic level of output 48 of reversing logic 76 will control the order in which decoders 36, 37 and 38 are enabled.

Reversing logic 76 consists of a single D type flip flop 118 and several logic gates, as can be seen in FIG. 2. Whenever switch 54 is in the open position, the first input to AND gate 120 will be at logic 0, thus holding flip flop 118 in the cleared, or the Q to logic 0, state. Switch 56 is connected to the input of an AND gate 122. With switch 54 and switch 56 both in the open position, both inputs to AND gate 122 will be at logic 1 and, therefore, output 48 of reversing logic 76 will be at logic 1.

This position corresponds to arpeggio down. With switch 54 open and switch 56 closed, the outputs of AND gate 122 will switch to logic 0 and the output 48 of reversing logic 76 will similarly switch to 0, indicating arpeggio up. When switch 54 is closed, the first input to AND gate 122 is held at logic 0 and the output thereto will be held to logic 0.

However, with switch 54 closed, the first input to AND gate 120 will now be at logic 1 and when latch 56 is set, indicating the start of an arpeggio cycle, the second input to AND gate 120 will also go to logic 1. With both inputs to AND gate 120 at logic 1, the clear terminal of flip flop 118 will also be at logic 1, thus releasing flip flop 118 for operation from the clocking input thereto. The Q output of flip flop 118 will remain at logic 0 until a clocking pulse occurs at the clocking input thereto, thus the output, which occurs when the logic 1 signal shifting through shift register 42 reaches bit sixteen of shift register 42, indicating that decoders 36, 37 and 38 have been enabled for a full arpeggio up cycle. Once flip flop 118 is clocked, the output of reversing logic 76 will switch to logic 0.

Also, with switch 54 closed, latch 52 will prevent stop logic 66 from clearing latch 56 until a cycle of arpeggio down has been completed. This is accomplished by holding the Q output of flip flop 98 at logic 1 level which, in turn ,is accomplished by connecting output 49 to latch 52 as shown in FIG. 2, which prevents the logic 0 pulse derived from output16 of shift register 42 from clearing latch 52 through AND gate 99.

Figure 4:
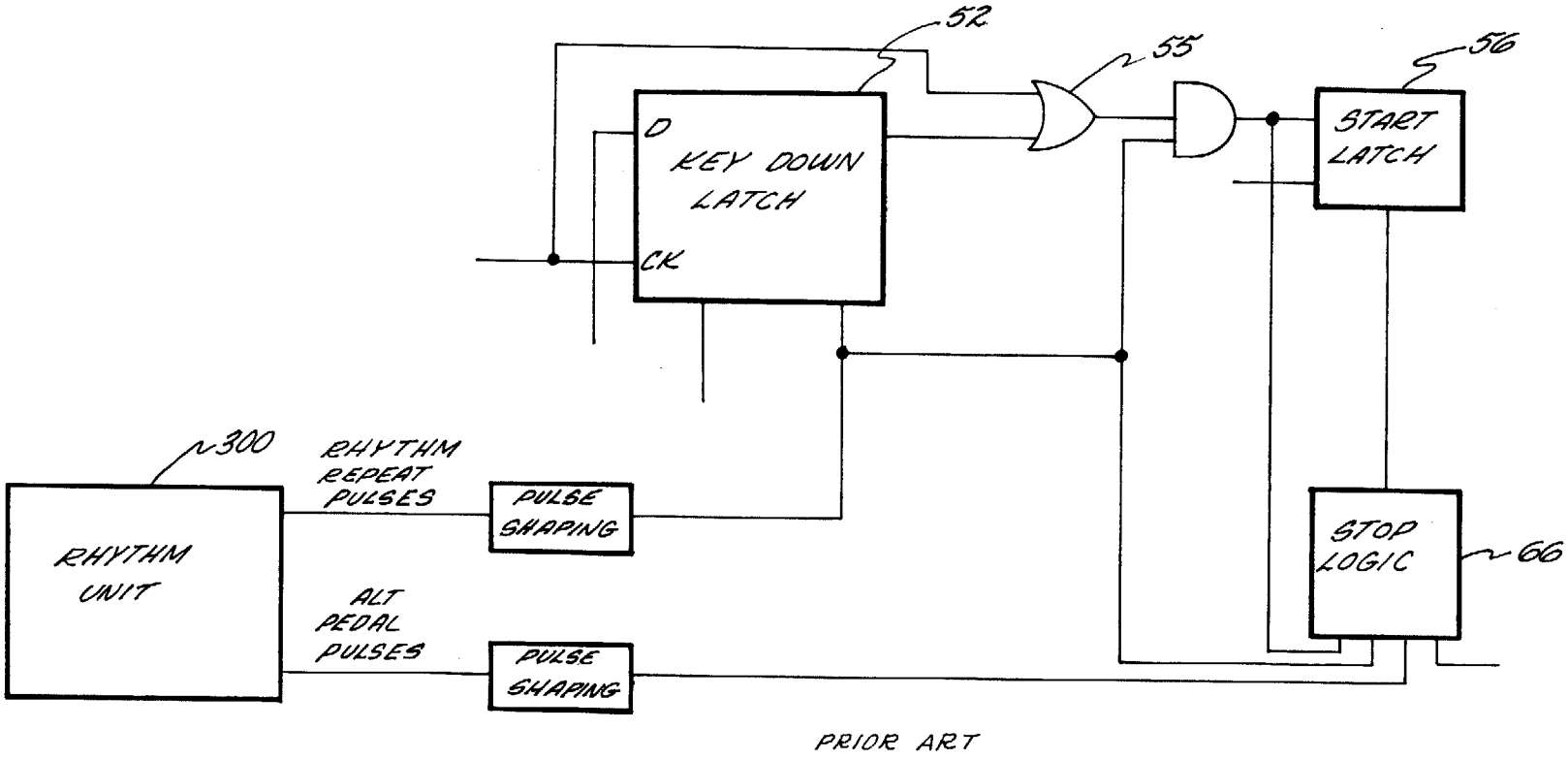
FIG. 4 illustrates a modification to the present system which enables rhythm patterns to be produced in the solo manual.

FIG. 4 illustrates a prior art version of the present system wherein rhythm patterns are generated in the solo manual. A portion of the circuitry of FIG. 1 is shown wherein clock 62 and knee switch 50 are replaced by outputs from the rhythm unit 300. Specifically, rhythm repeat pulses, the pattern of which may be varied, form inputs to latch 52, start latch 56 and stop logic 66. A further input to stop logic 66 is provided by pedal pulses from the rhythm unit 300.

OPERATION

In operation, with switch 51 in the "OFF" position, the organ can be played in a conventional manner and the arpeggio system according to the present invention will not be enabled. If, however, switch 51 is in the "ON" position, the arpeggio system is partially enabled and if, during playing, the operator closes knee switch 50, this will complete the enabling of the arpeggio circuit according to the present invention.

Thereafter, upon the depressing of one of the chord playing keys, a key-down pulse will be developed and this will initiate an arpeggio cycle. The cycle which is initiated by the momentary depressing of a key consists, in one case ,of the playing of the notes of the chord pertaining to the respective key in succession, commencing at one end of the manual and proceeding to the other end of the manual and at a rate determined by clock 62.

Two further switches are important in respect of the operation of the arpeggio circuit. When switch 54 is closed, the arpeggio commences at one end of the keyboard and progresses to the other and then returns to the first end of the keyboard.

If switch 54, however, is opened, the arpeggio will commence at one end of the keyboard and run to the other end and then stop, with the particular direction in which the arpeggio proceeds along the keyboard determined by switch 56, which is closed for one direction of operation and open for the other. Closing of switch 56 while switch 54 is closed is without effect.

The cycle of operation described above pertains when a chord playing key is momentarily depressed. If, however, a chord playing key is held in closed position, the cycle which is selected by switches 54, 56, is repeated until the chord playing key is released. When the chord playing key is released, whatever cycle is in progress will continue until it is completed and the system will then shut down until it is again made operative by the depression of a chord playing key.

If knee switch 50 is released at any time, any arpeggio cycle then in process will be interrupted immediately, and if no cycle is in process, the arpeggio system will be disabled.

What is claimed is:

1. In an electronic organ having playing keys forming a keyboard and being grouped in a plurality of successively adjacent octaves, a multipitch tone generator, a transducer, a keyer connecting each pitch to the transducer, main multiplexer means for scanning the keys and developing a main data stream on each scan containing key-down signals in respective time slots corresponding to depressed keys, and demultiplexer means receiving said main data stream from the multiplexer means and actuating said keyers in conformity with said key-down signals, an arpeggiator comprising: second multiplexer means synchronized with said main data stream for developing an octave length second data stream containing key-down signals in time slots corresponding to notes of a selected chord played consecutively, arpeggio means for sequentially selecting successive octaves at a rate which is substantially lower than the rate at which said main multiplexer means scans said keys and for repetitively supplying said second data stream to said demultiplexer means only during the scanning of the selected octave by said main multiplexer means, said arpeggio means including variable frequency and variable duty cycle clock means for selectively controlling the rate at which said octaves are successively selected and for selectively controlling the duration and spacing of successive notes of the selected chord.

2. An electronic organ according to claim 1 in which said arpeggio means selects said octaves in succession proceeding from one end of the keyboard toward the other end thereof.

3. An electronic organ according to claim 1 in which said arpeggio means selects said octaves in succession proceeding from one end of the keyboard to the other end thereof and then back toward the said one end of the keyboard.

4. An electronic organ according to claim 1 in which said clock means is operable for setting the rate at which the key-down signals corresponding to different notes of the selected chord are selected for supply to said second data stream and is thus operable for controlling the arpeggio rate.

5. An electronic organ according to claim 1 in which said organ includes a group of accompaniment chord playing keys, and means operable in response to the depression of a said chord playing key for developing key-down signals for insertion into said second data stream.

6. An electronic organ according to claim 5 which includes means for inserting the key down signals developed by the depression of each chord playing key in time slots of said second data stream corresponding to the notes of the chord pertaining to the respective chord playing key.

7. An electronic organ according to claim 5 which includes means for inserting the key down signals developed by the depression of each chord playing key in time slots of said second data stream harmonious with the notes of the chord pertaining to the respective chord playing key.

8. An electronic organ according to claim 1 which includes second selector means operable to select the end of the keyboard from which an arpeggio passage will start.

9. An electronic organ according to claim 8 in which said second selector means is also selectively operable to cause the arpeggio passage to travel along the keyboard in one direction and then to return in the other direction.

10. An electronic organ according to claim 1 which includes manually adjustable switch means movable into position partially to prepare said arpeggio means and a momentary player operated switch means operable therefor to complete the preparation of said arpeggio means.

11. An electronic organ according to claim 10 in which depression of a chord playing key is operable for initiating an arpeggio passage when said arpeggio means in completely prepared, said arpeggio means being operable for continuing the selected arpeggio cycle for one complete cycle when a chord playing key is momentarily depressed and repetitively when a chord playing key is held depressed.

12. An electronic organ according to claim 11 in which said arpeggio means includes means for interrupting an arpeggio passage in response to opening of one of said switch means.

13. An electronic organ according to claim 1 in which said arpeggio means includes a group of chord playing keys, memory means addressed by said chord playing keys and developing a respective group of at least three outputs in response to the depression of each chord playing key, at least three decoders each addressed by a respective one of said outputs and each developing a twelve bit output having at least one key down signal in a respective location therein, means interconnecting the outputs of said decoders to form the twelve bit input to said second multiplexer means, and means for repetitively enabling said decoders in succession at arpeggio rate.

14. An electronic organ according to claim 13 which includes latch means interposed between said memory means and said decoders.

15. An electronic organ according to claim 13 which includes means for selecting the rate and order of enabling of said decoders.

16. An electronic organ according to claim 13 which includes delay means operable for clocking said latch means in response to the depression of a chord playing key and the elapse of a selected number of cycles of said main multiplexer means.

17. In an electronic organ having playing keys forming a keyboard, said keys being grouped in a plurality of successive octaves, a multipitch tone generator, a transducer, a keyer connecting each pitch of the tone generator to the transducer, main multiplexer means for scanning the playing keys and developing a main data stream on each scan containing key-down signals in respective time slots corresponding to depressed playing keys, and demultiplexer means connected to receive the main data stream from the multiplexer means and operable to actuate the keyers in conformity with the key-down signals, an arpeggiator comprising:

octave scanned counter means for providing a plurality of time displaced first output signals as the octaves are scanned, said output signals corresponding respectively to individual ones of said octaves, desired octave counter means for successively providing second output signals corresponding respectively to individual ones of said octaves at a rate substantially lower than the rate said first output signals are provided by said octave scanned counter means, means for producing a second data stream containing key-down signals corresponding to notes of a selected chord played as an arpeggio, variable frequency and variable duty cycle clock means for selectively controlling said for producing a second data stream means so as to determine the duration and spacing of successive notes of the selected chord corresponding to the key-down signals produced thereby, and means for receiving said first and second output signals and impressing said second data stream on said first data stream in synchronism therewith when the first and second output signals received thereby correspond to the same octave.

18. In an electronic organ having playing keys forming a keyboard and being grouped in a plurality of successively adjacent octaves, a multipitch tone generator, a transducer, a keyer connecting each pitch to the transducer, main multiplexer means for scanning the keys and developing a main data stream on each scan containing key-down signals in respective time slots corresponding to depressed keys, and demultiplexer means receiving said main data stream from the multiplexer means and actuating said keyers in conformity with said key-down signals, an arpeggiator comprising: means for developing a second data stream synchronized with said main data stream containing key-down signals in time slots corresponding to notes of a selected chord played consecutively over a plurality of successive octaves at a rate which is substantially lower than the rate at which said main multiplexer means scans said keys and supplying said second data stream to said demultiplexer means, and variable frequency and variable duty cycle clock means controlling said means for developing a second data stream to selectively control the duration and spacing of the notes of the selected chord.

19. The electronic organ of claim 17 wherein said variable frequency and varable duty cycle clock means controls the rate at which said second counter means is clocked.

* * * * *